US006119502A

United States Patent [19]

Buchmayer

[11] Patent Number: 6,119,502

[45] Date of Patent: Sep. 19, 2000

[54] HAND HELD COMPRESSED AIR POWERED CRIMPING TOOL TO SECURE RING TONGUE TERMINALS TO STRIPPED ELECTRICAL WIRE ENDS, AND TO SECURE BUTT SPLICES TO JOIN TWO ELECTRICAL WIRE ENDS

[76] Inventor: Ernst Buchmayer, 117, 129th NE. Ave., Bellevue, Wash. 98005

[21] Appl. No.: 09/253,975

[22] Filed: Feb. 22, 1999

[51] Int. Cl.[7] ..... H01R 43/042

[52] U.S. Cl. ..... 72/404; 72/412; 72/453.16; 29/751

[58] Field of Search ..... 72/404, 409.01, 72/409.11, 453.16, 453.15, 412; 29/751

[56] References Cited

U.S. PATENT DOCUMENTS

| | | | |
|---|---|---|---|
| 2,892,368 | 6/1959 | Demler | 72/404 |
| 2,931,260 | 4/1960 | Townshend | 72/409.01 |
| 2,947,207 | 8/1960 | Demler | 72/404 |
| 3,293,732 | 12/1966 | Broske | 29/155.5 |
| 3,867,754 | 2/1975 | Koch et al. | 29/203.05 |
| 4,774,762 | 10/1988 | Gobeil | 29/861 |
| 5,309,751 | 5/1994 | Ryan | 72/450 |
| 5,487,297 | 1/1996 | Ryan | 72/450 |
| 5,490,406 | 2/1996 | College | 72/30.1 |
| 5,509,194 | 4/1996 | Hornung et al. | 29/751 |
| 5,596,800 | 1/1997 | Holliday et al. | 29/751 |
| 5,787,754 | 8/1998 | Carrion | 72/407 |

FOREIGN PATENT DOCUMENTS

| | | | |
|---|---|---|---|
| 494963 | 8/1953 | Canada | 72/453.15 |

OTHER PUBLICATIONS

Amp Inc. Instruction/Maintenance/Inspection Sheet of 3 pages for "T" Head Crimping Tools; Copyrights of 1960 Thru 1990.

*Primary Examiner*—Daniel C. Crane
*Attorney, Agent, or Firm*—Roy E. Mathern, Jr.

[57] ABSTRACT

A hand held compressed air powered crimping tool is used both to secure ring tongue terminals to stripped electrical wire ends, and to secure butt splices that join together two electrical wire ends. The dies used, their locations, their retention, and their movements are similar to existing "T" head crimping tools, which are finger and hand manipulated and powered. When using this compressed air powered tool, pre-positioning is still undertaken by fingers and hands, of wires, ring tongue terminals or the butt sleeves, and insulation covers, to be crimped. Continued finger and hand movements, move together respective "T" head portions to preliminary keep together all the members to be crimped, in their respective positions. At the conclusion of the preliminary positioning, no spaces are left around dies for any unwanted entry of finger portions of the operator. At the last moment of the preliminary positioning, a blocking member of a safety linkage is cleared away from respective receiving volumes, permitting the subsequent entry of respective depending safety portions of a finger actuated hinged lever trigger. The trigger, when intentionally moved, depresses an upstanding air valve stem to open the air valve for the flow of compressed air to the pneumatic actuator that completes the movements of the overall crimping linkage. Preferably, a monitoring linkage is moved during the preliminary positioning, to insure the members to be crimped are securely held, until the compressed air power is subsequently utilized. The monitoring linkage must complete its travel during the powered fall crimping action directional sequence period, before it reverses its travel direction to clear the way for a release opposite directional movement of the crimping linkage undertaken, when compressed air power is off, and a return force is provided by a compression spring.

7 Claims, 10 Drawing Sheets

HAND HELD COMPRESSED AIR POWERED CRIMPING TOOL TO SECURE RING TONGUE TERMINALS TO STRIPPED ELECTRICAL WIRE ENDS, AND TO SECURE BUTT SPLICES TO JOIN TWO ELECTRICAL WIRE ENDS

BACKGROUND

When electrical wire circuits are to be extended and/or connected in installation locations, where portable hand held, manipulated, and operated crimping tools are utilized to secure insulated butt splices to join two electrical wire ends, and/or to secure insulated ring tongue terminals to stripped electrical wire ends, many of these crimping tools have "T" heads used in positioning respective pairs of like sized crimping dies, at two spaced locations in the "T" head. Each location has a different size of crimping dies. Available in the past and still in the present is the completely hand and finger held, and operated portable crimping tool having a "T" head, known as an AMP "T" head crimping tool.

It is believed this "T" head arrangement of respective sets of crimping dies has not been available in a portable hand held tool that does not completely rely on hand power.

It is understood that AMP Incorporated and other companies do provide portable crimping apparatus for crimping electrical terminals onto conductors, and these portable products are selectively powered by hydraulic actuators, compressed air actuators, and/or electric motors, each requiring an external power source. However, the "T" head arrangement of the crimping dies is not known to have been incorporated into these portable products.

By way of examples, in the respective U.S. Pat. Nos. 5,309,751; No. 5,487,297; and No. 5,490,406, assigned to The Whitaker Corporation, compressed air power is utilized in respective portable crimping tools, which are operated to crimp electrical wires together, yet the "T" head arrangements is not illustrated nor described.

There remained a need to incorporate such a "T" head arrangement of crimping dies, in respective spaced pairs of different sizes in a hand held, and finger and hand manipulated, portable electrical wire crimping tool, which, after the initial placement of the members, to be crimped, undertaken by finger manipulation, could thereafter be safely operated using an external power source, when finger portions of an operator were out of the way of the continued closing movements of the crimping dies.

SUMMARY

Many portable hand held crimping tools, which are fully operated by hand and finger applied forces, have been and are being used, which have so called "T" heads presenting two sets of dies of different crimping sizes. They are used, both to secure ring tongue terminals to stripped electrical wire ends, and also, alternatively, to secure butt splices to join two electrical wires. In production periods, when these fully hand and finger operated crimping tools are extensively used, the respective operators often tire and/or fail to always complete a full and successful crimping action.

Therefore, this hand held compressed air powered crimping tool is provided to operators, who will at first use their hands and fingers to pre-position in a "T" heads, the members to be crimped. Then, after this pre-positioning is completed, an operator whose fingers cannot then re-enter the motion path of the dies, will depress and pivot the cleared trigger to open an air valve to utilize the flow of compressed air into a pneumatic actuator, which moves the crimping linkage to complete the crimping motions of the dies; and the members are then fully crimped together.

The operator is not able to move the trigger until a safety linkage, interrelated with the overall crimping linkage, has a portion thereof, i.e. a blocking member, moved out of the way of depending portions of the trigger, during the closing moments of the finger force movements of the overall crimping linkage.

Via the operation of a monitoring linkage, which is also interrelated with the overall crimping linkage, the operator is able to ascertain when the finger force movements of the overall crimping linkage are sufficiently completed to firmly hold in place the members, to be subsequently crimped together, when the compressed air power is applied to the overall crimping linkage. In addition the monitoring linkage, during the powered crimping operational period, prevents the reversal of movements of components of the overall crimping linkage. Then, when the powered crimping operational period is fully completed, and the members are successfully crimped together, the monitoring linkage then has been moved to clear the way for the reversal of motion of the overall crimping linkage. The reversal occurs under the force of a compression spring, to separate the crimping dies in the "T" head for the convenient removal of the members that are well crimped together.

During the crimping of ring tongue terminals to stripped electrical wire ends, when insulation is also crimped into position, respective insertion stops are in position in the "T" head locale to stop the insertion of the ring tongue terminals at a pre-designated location. At alternate times, when butt splices to join two electrical wires are to be crimped, the respective insertion stops are quickly and conveniently moved out of the way.

Except for the extending portions of the "T" head from a housing at one end thereof, the extending portions of a pneumatic actuator at the opposite end of the housing along with an extending compressed air supply line, and the raised hinged trigger mechanism, the balance of the components of the crimping tool, such as the various linkages, the compressed air passageways and the air valve, are all positioned within a two piece rectangular essentially hollow housing having positioners, linkage guiding groves, and openings to receive fasteners, portions of the trigger mechanism, and rotational shafts of the crimping linkage.

DRAWINGS

The hand held compressed air powered crimping tool, to secure ring tongue terminals to stripped electrical wire ends, and to secure butt splices joining together two electrical wire ends, which utilize the "IT" head arrangements of spaced sets of respective matched crimping dies of different set sizes, is illustrated in the drawings, wherein:

FIG. 1 is a perspective view of the tool ready to receive a ring tongue terminals, with an insulator, and a stripped electrical wire end in a selected set of respective matched crimping dies, of two available spaced apart sets of respective crimping dies arranged in the centrally positioned "T" head arrangement, and showing a portion of the compressed air line, and the hinged thumb or finger depressible trigger, which is in the non actionable position during the pre-positioning time of the members to be crimped, and also showing how the cylinder of the pneumatic actuator is positioned to centrally extend from the housing to serve as a handle of the tool;

Figure 4:
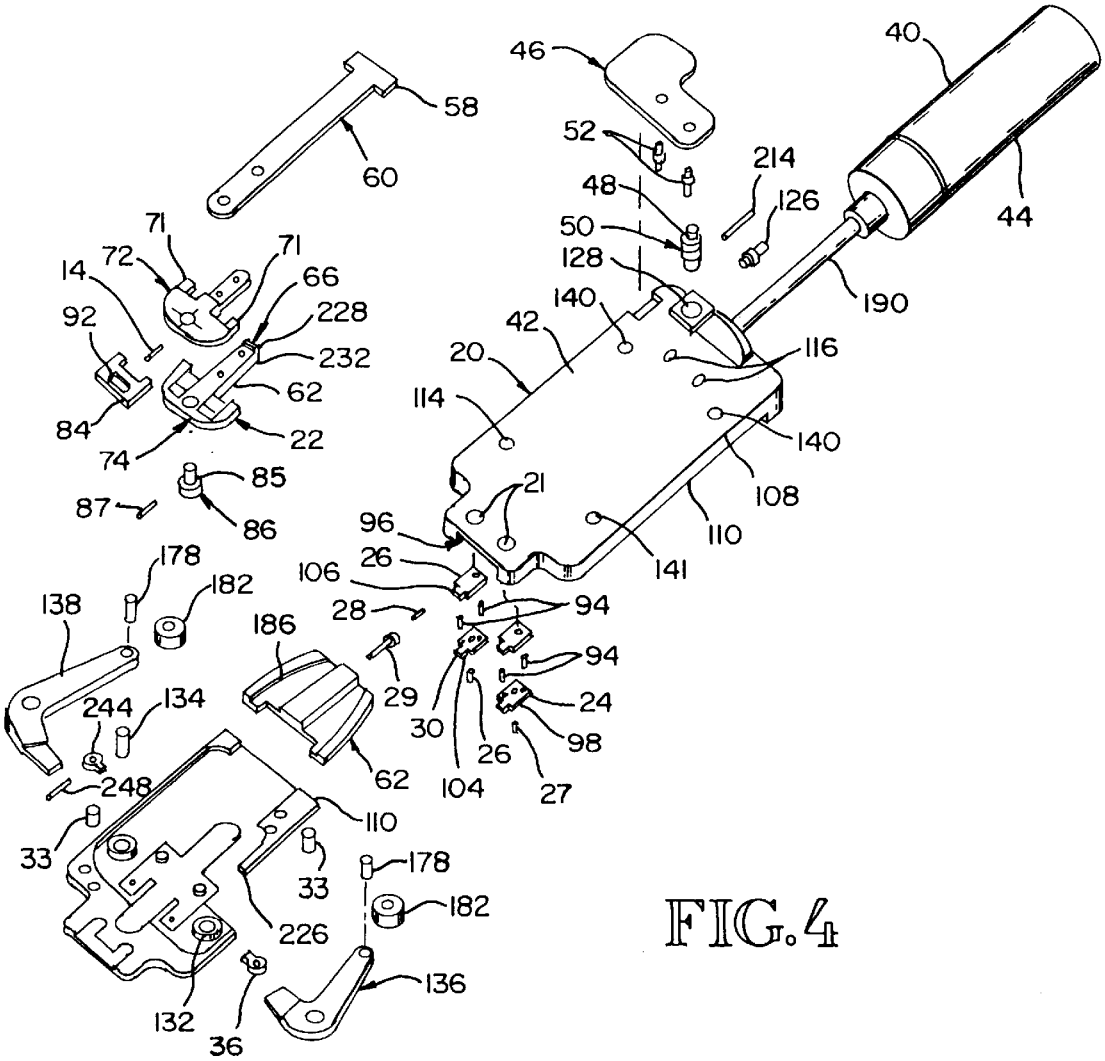
Figure 5:
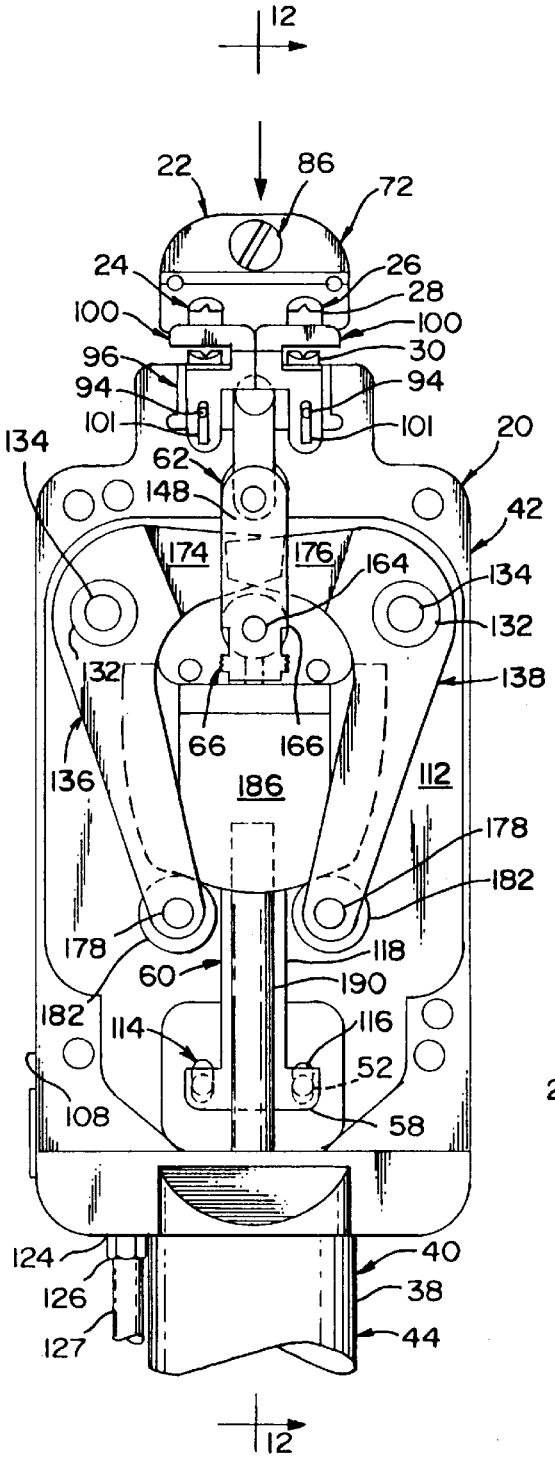
Figure 6:
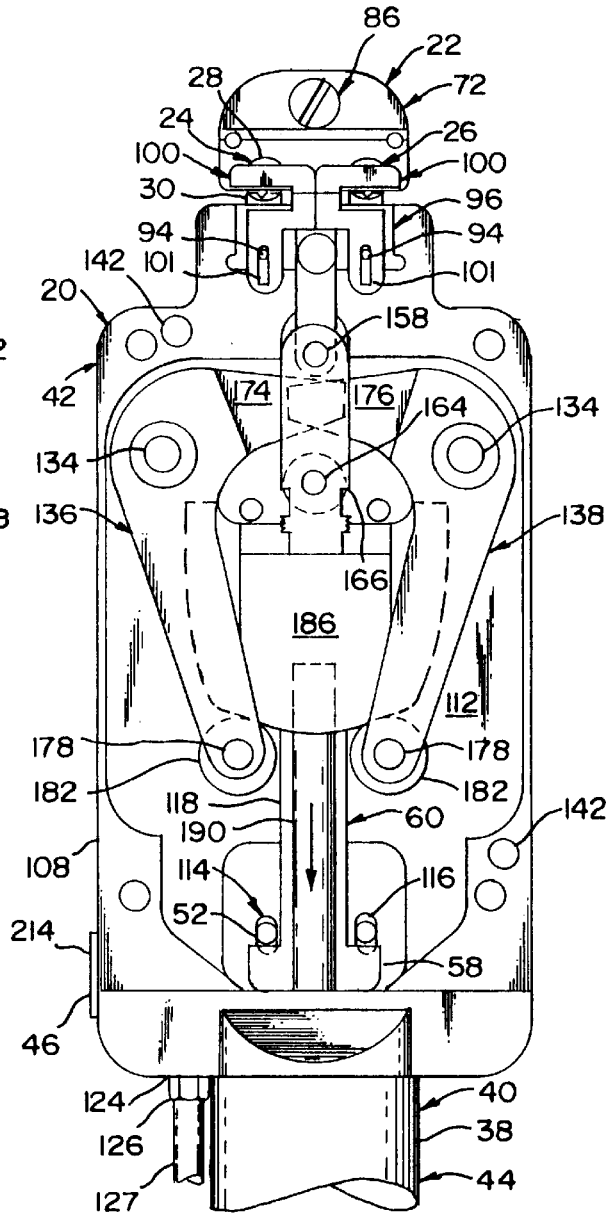
Figure 7:
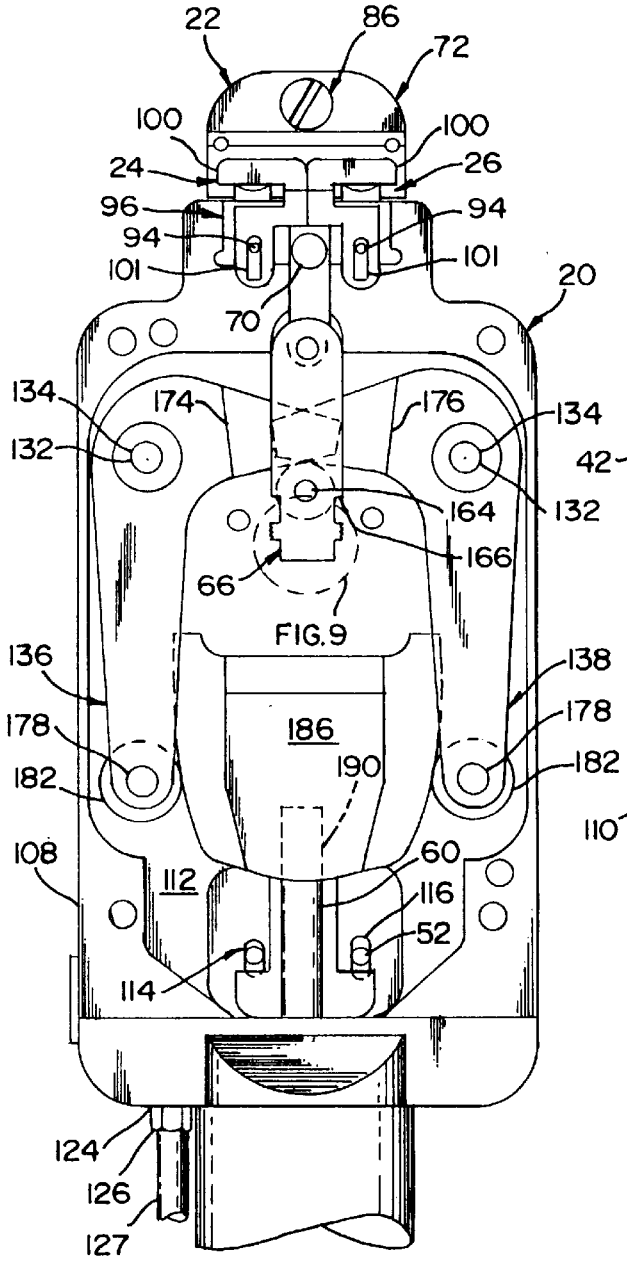
Figure 8:
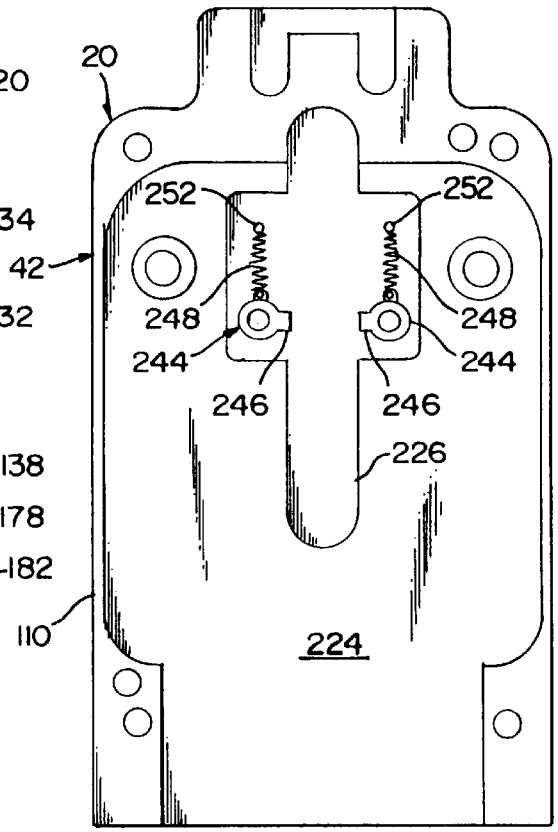
Figure 9:
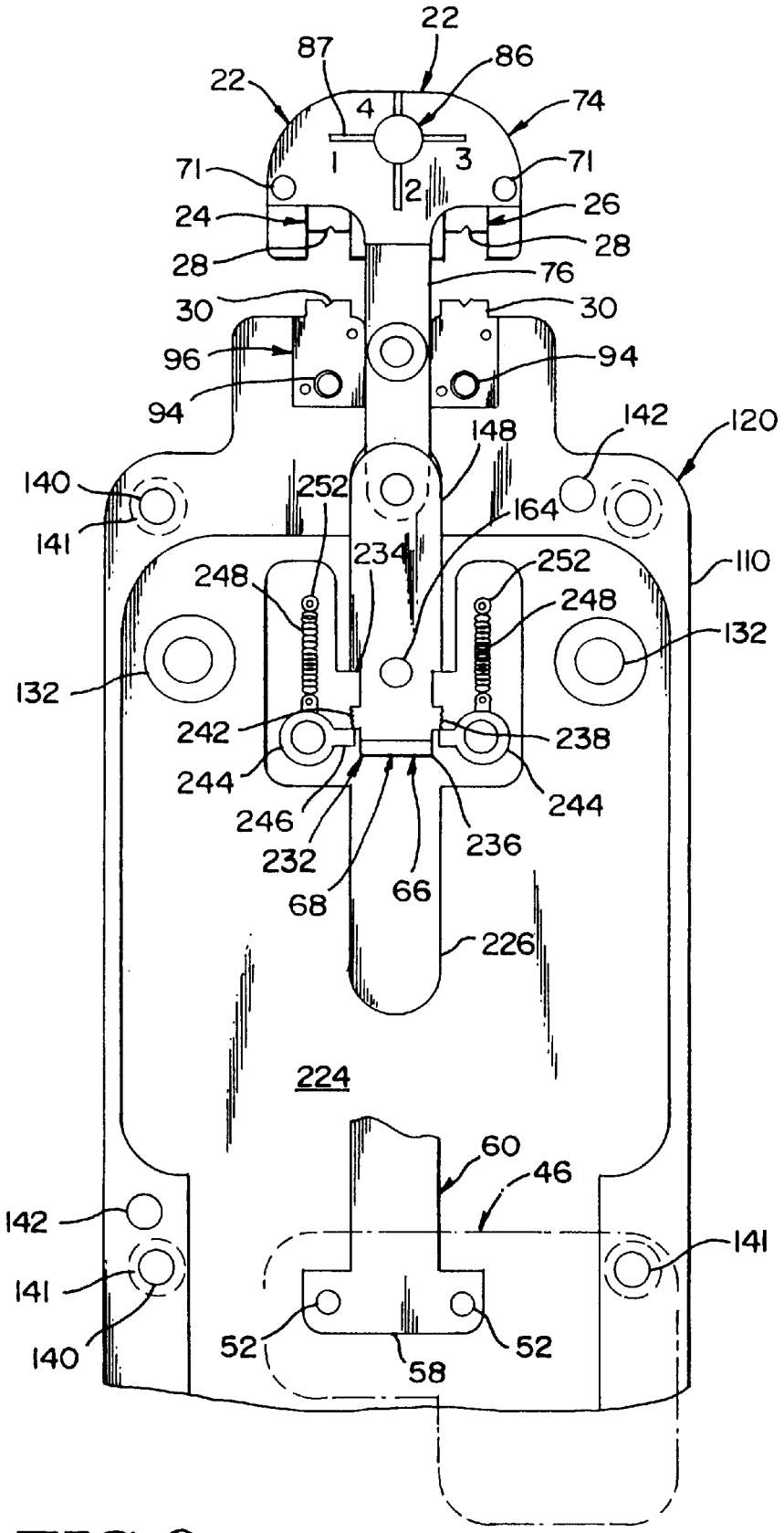
Figure 10:
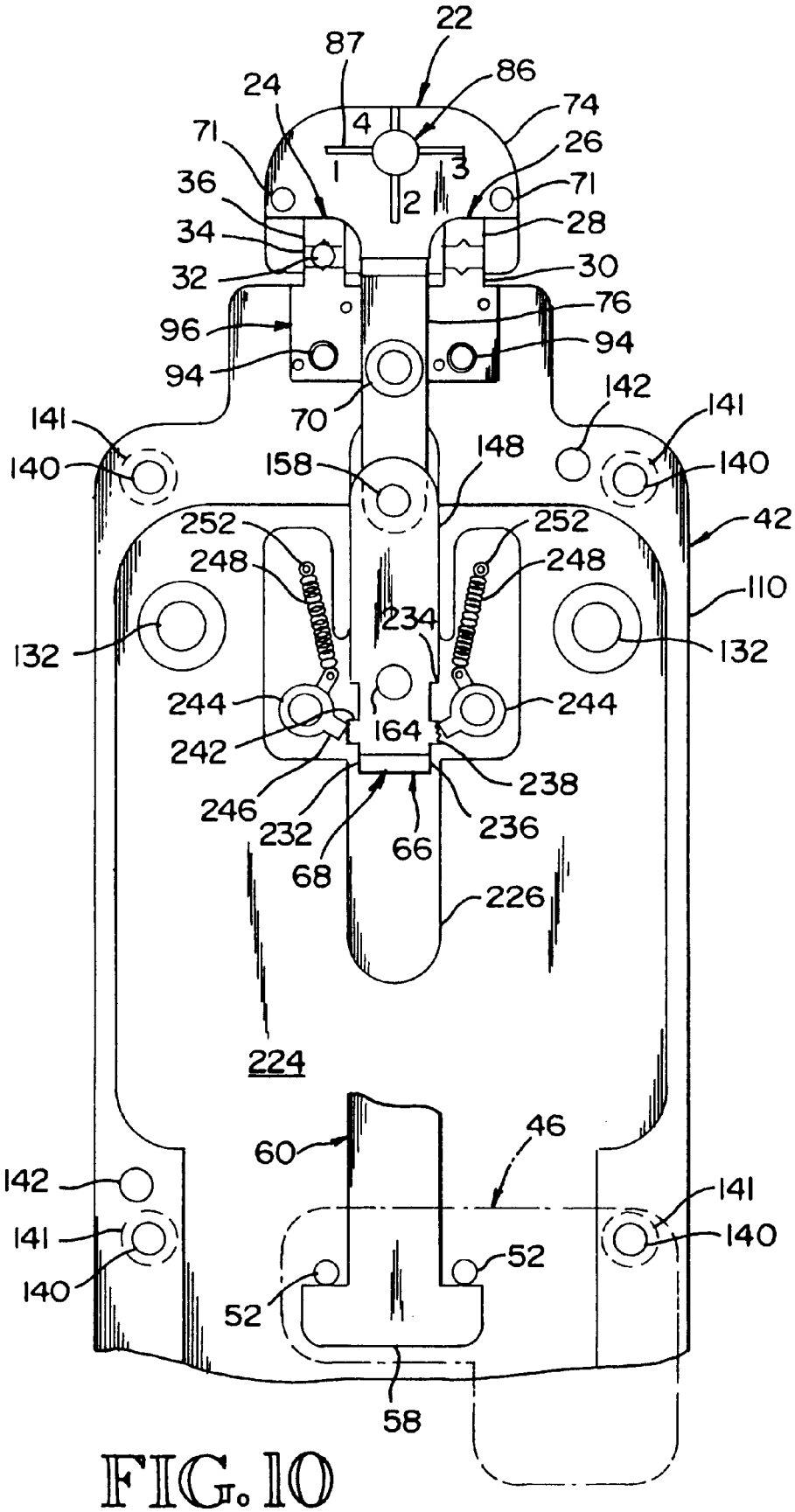
Figure 11:
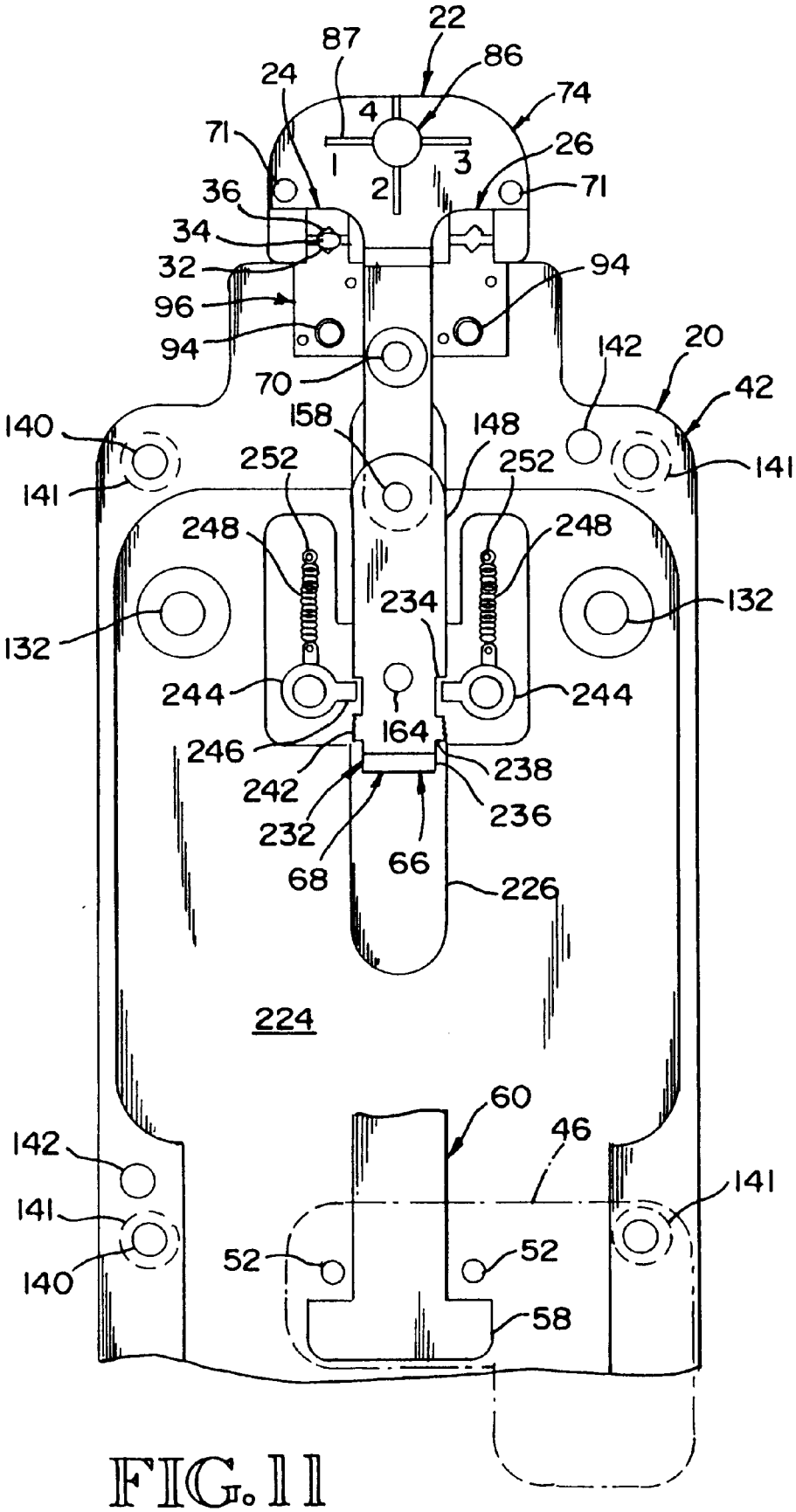
Figure 12:
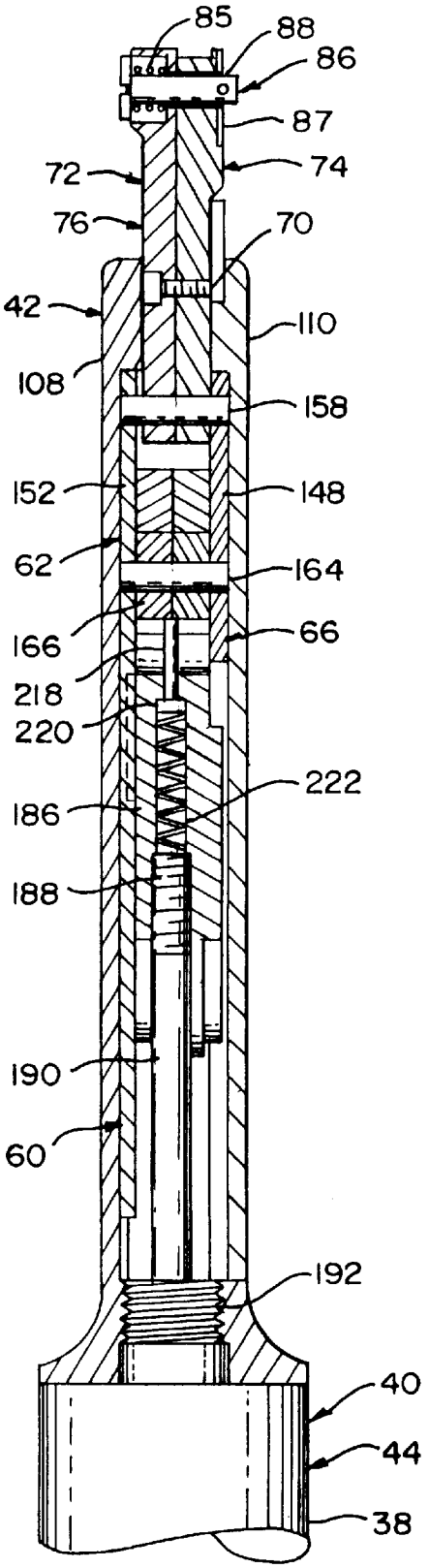
Figure 13:
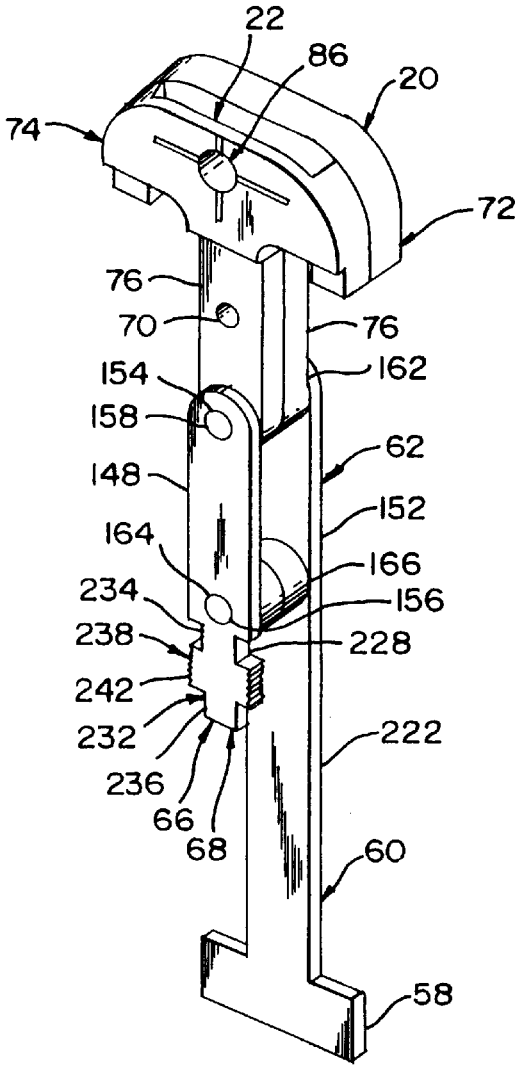
Figure 14:
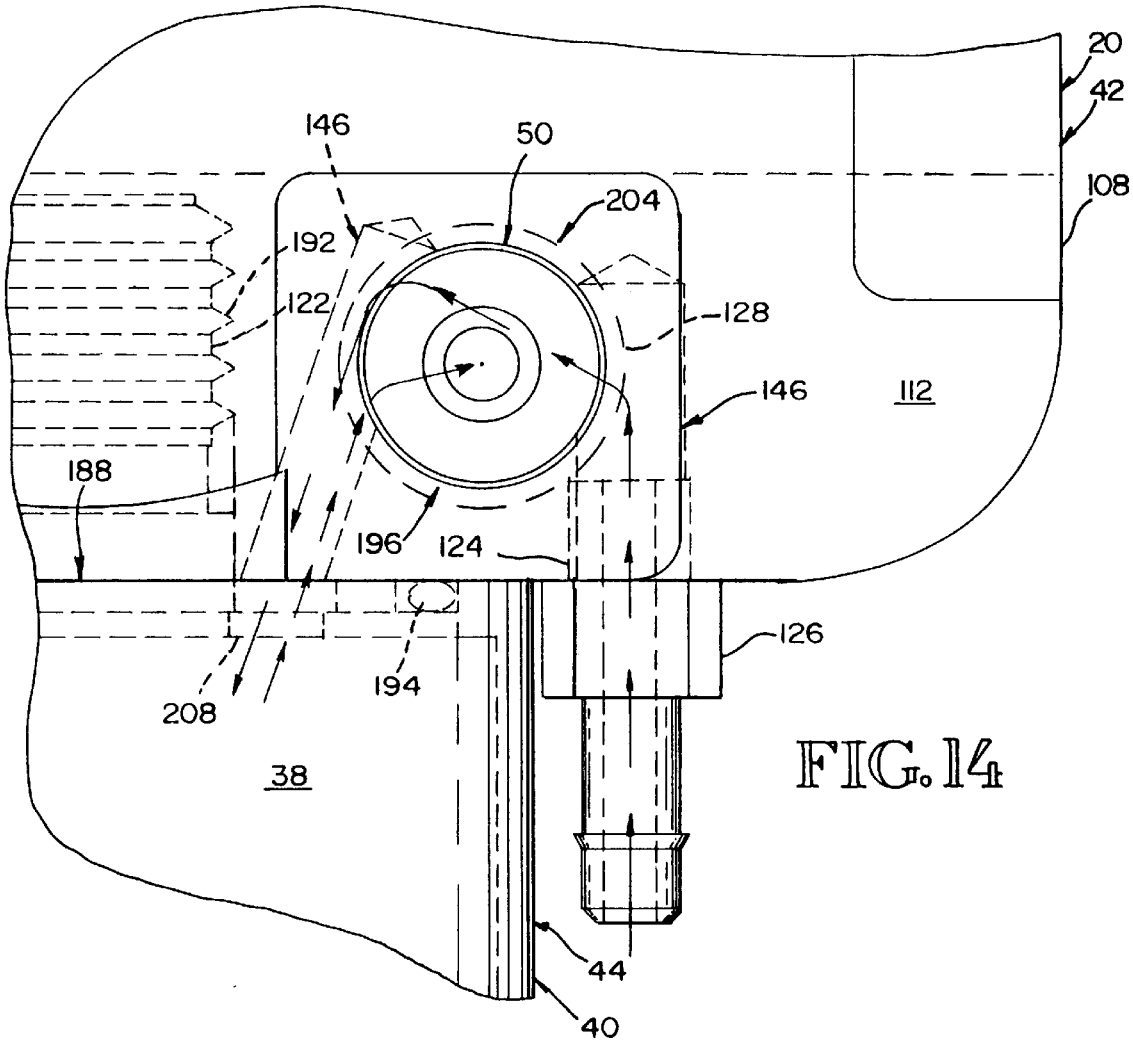
Figure 15:
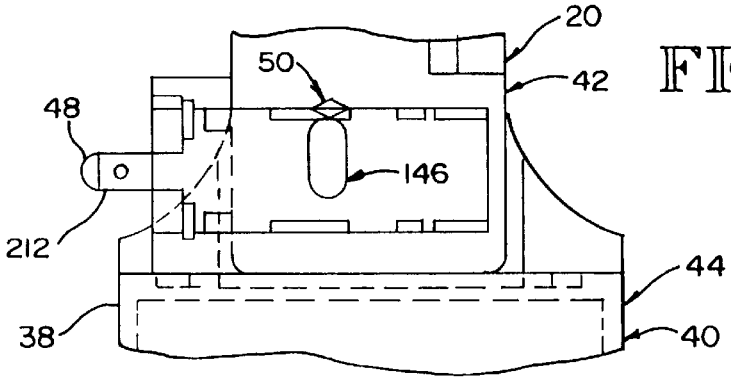

FIG. 4 is a perspective exploded view of both individual parts and partially assembled parts of the hand holdable crimping tool, FIG. 5 is view looking into the interior of the housing of the tool, after the cover has been removed, and showing the arrangement of many of the parts, before the pre-positioning of the members to be crimped, indicating that the crimping dies are in their open positions, and the blocking member of the safety linkage is covering the entries of receiving volumes, which subsequently will receive depending portions of the hinged trigger, and also showing how the overall crimping linkage is arranged in the starting position thereof before and during the propositioning of the members to be crimped;

FIG. 6 is a view, similar to the view of FIG. 5, looking into the interior of the housing of the tool, after the cover has been removed, showing, however, how the "T" head has been finger manipulated to pre-position members to be crimped, which, for illustration purposes are not shown, so the positioning of the stops is shown more clearly, and the motion arrow indicates the direction of the soon to be operated rod that extends from the pneumatic actuator into the housing and is attached to the overall crimping linkage, and, at this operational time, the blocking member of the safety linkage is not covering the entries of the receiving volumes, which soon will be receiving depending portions of the hinged trigger when the compressed air flow will be occurring;

FIG. 7 is a view, similar to the views of FIGS. 5 and 6, looking into the interior of the housing of the tool, after the cover has been removed, showing, however, the "T" head had been finger manipulated to pre-position the members to be crimped, not shown, and then the pneumatic actuator has been operated to power the overall crimping linkage to fully crimp the members together;

FIG. 8 is a view looking into the interior of the cover of the housing to illustrate: a guiding groove to guide the movement of portions of the monitoring linkage, not shown; and to show the initial positioning of two spaced rotatable pawls, having projecting portions, which changeably contact portions of the monitoring linkage, and the initial positioning of the pawls and their return to their initial positioning is controlled by the respective forces of their respective coiled springs;

FIGS. 9, 10, and 11, are similar partial enlarged views to illustrate how relative positions of the spaced rotatable pawls having the projecting portions, as shown in FIG. 8, change in relationships with cam portions of the monitoring linkage, some of which portions have ratchet teeth projections; with FIG. 9, showing their relationships at the outset of operations, when the members to be crimped are yet to be placed between the open dies; with FIG. 10 showing their relationship during the finger powered closing of the respective dies about the members to be crimped, and when the dies are so completely moved, the ratchet teeth projections maintain this completely closed position to await the start of the pressurized air power crimping operation; and with FIG. 11 showing their relationship after the completion of the pressurized air power crimping operation, when the spaced rotatable pails are then cleared away to indicate the successful full cycle of the cramping operation and to not interfere with the return of the overall crimping linkage to the starting positions thereof, to enable the release of the crimped members for their removable from between the dies, and to be reader to enable the insertion of new members between the dies for their subsequent successful crimping, and the positioning of the safety linkage, in respect to its blocking member, is illustrated, when blocking in FIG. 9, and not blocking on FIGS. 10 and 11, with respect to the movement of the trigger;

FIG. 12 is an enlarged cross sectional view, taken along section line 12—12 appealing in FIG. 5, to specifically show: how the various linkages, i.e. crimping, safety, and monitoring linkages, are interconnected; how the pneumatic actuator is connected to the crimping linkage; and the utilization of a return force compression spring;

FIG. 13 is a partial perspective view of the assembly of some of the components of the respective crimping, safety, and monitoring linkages, and their attachments to the "T" head; and FIGS. 14 and 15 are partial sectional views to show the arrangement of the compressed air passageways, some of which are formed in housing, with arrows indicating the flow of the pressurized air form the an line, through the connection nipple, into the air valve, through a diagonal passageway in the housing, and into the cylinder of the compressed air actuator, and also indicating, when the pressurized air is shut off, the exhausting air leaves through an exhaust passageway and then through an exhaust hole in the air valve.

DESCRIPTION OF THE PREFERRED EMBODIMENT

Introduction

The hand held compressed air powered crimping tool 20, is illustrated in a preferred embodiment in drawings. In all embodiments, this crimping tool 20 includes the well known and utilized "T" head assembly 22, which positions two spaced sets 24, 26 of dies of respective matching sizes of upper dies 28 and lower dies 30. These "T" head assemblies 22 were and are being used in hand held crimping tools that are completely manipulated by the hands and fingers of the operators. They are useful in securing members, such as ring tongue terminals 32 to stripped electrical wire ends 34 and also to secure butt splices that join together two electrical wire ends, along with their respective insulators 36.

They are used anywhere where needed, but especially in locales that are remote from shop, and working bench locations. The operators may tire during a working period in undertaking and completing all of the scheduled crimping operations. Therefore, where it is possible to have a compressed air supply source in an area where crimping operations are to be undertaken, this crimping tool 20 may be used by operators. They may conveniently hold, manipulate, and operate this crimping tool 20 with less effort while creating the better crimping of the members to complete electrical circuits and/or to complete circuit connections to electrical equipment. Very importantly, the operators, who utilize this crimping tool 20 know their fingers will not be injured by the crimping dies, when the pressurized air power is being utilized to crimp the members together.

Figure 1:
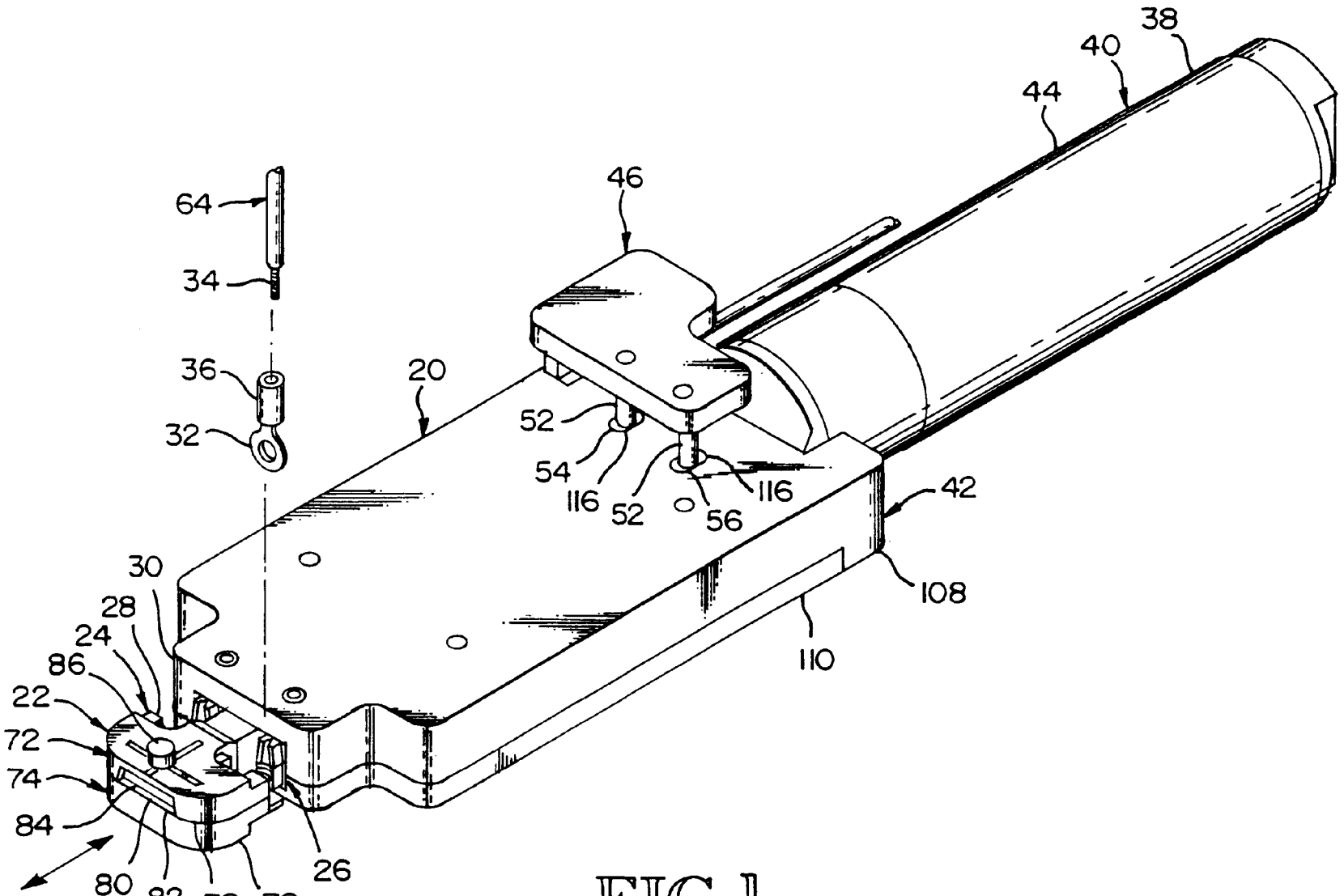
Figure 2:
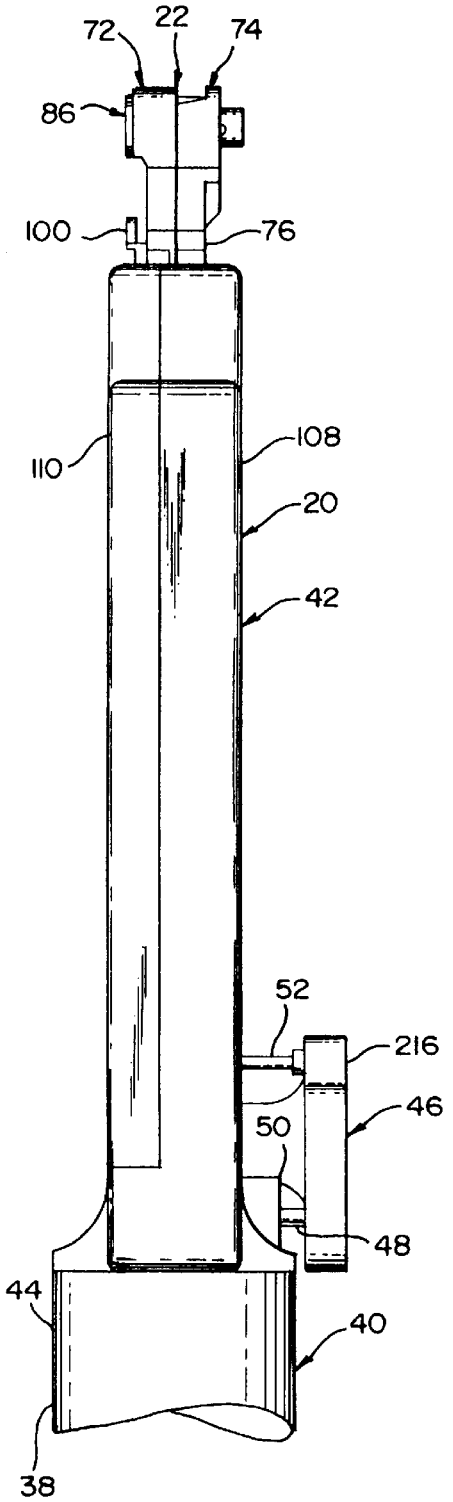
FIG. 2 is a partial side view of the tool showing: the positioning of stops used in placing the ring tongue terminals in the same position for each respective crimping operation; and the hinged thumb or finger depressible trigger in the non actionable position during the pre-positioning time of the members to be crimped; and a portion of the compressed air actuator.
Figure 3:
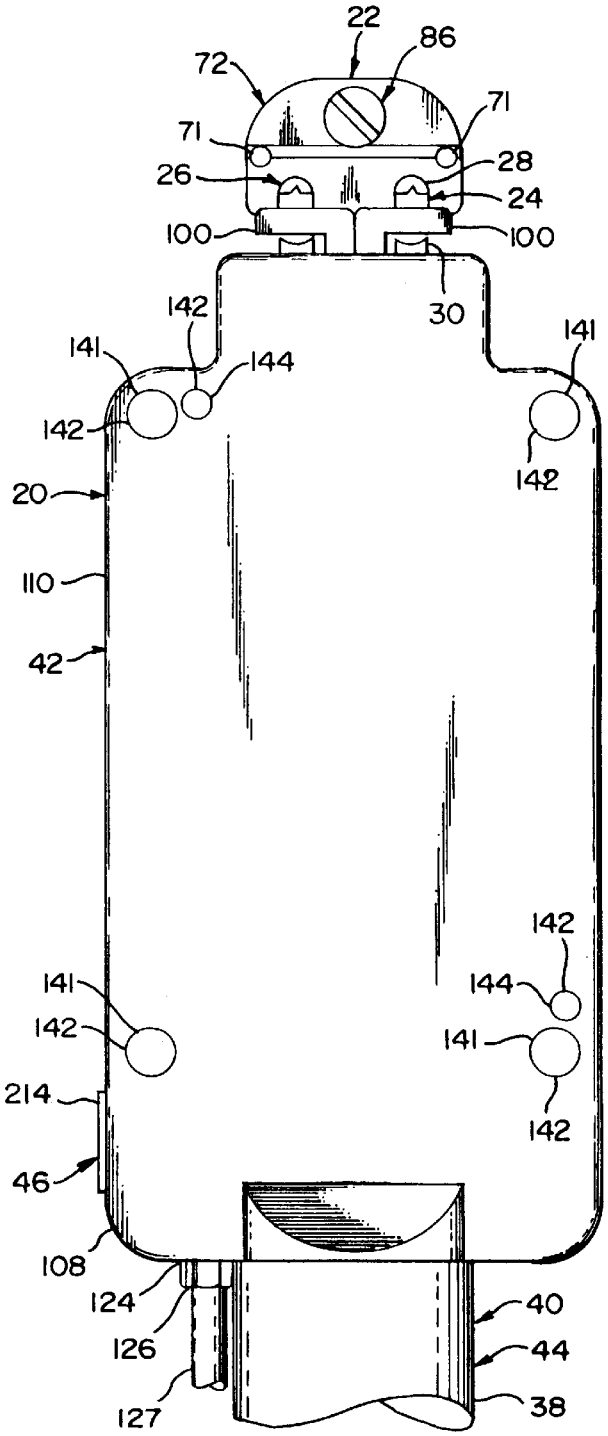
FIG. 3 is a partial back view of the tool showing:the stops used in placing the ring tongue terminals in their alike pre-positioning locations; the matching crimping dies in their open positions; a portion of the compressed air line; and a portion of the compressed air actuator.

As noted in FIG. 1, the cylindrical exterior of the cylinder 38 of the compressed air actuator 40 is extendably positioned from a hollow housing 42 to serve as a handle 44. When an operator's hand is placed about the handle 44, his or her thumb or finger is conveniently positioned to depress the pivotal trigger 46, which contacts a valve stem 48 of a compressed air valve 50 positioned in the hollow housing 42.

This pivotal trigger 46 cannot be depressed until a depending portion or portions thereof, such as depending pins 52, can enter into the hollow housing 42. Pin receiving volumes 54, 56, in the hollow housing 42, are obstructed by a blocking member 58 of a safety linkage 60, arranged in the hollow housing 42 and interconnected with the crimping linkage 62, which, is also arranged in the hollow housing 42.

After the members to be crimped, such as a ring tongue terminal 32, an insulator 36, and an electrical wire end 64, in respect to a stripped electrical wire end 34, are finger manipulated and placed between the upper and lower dies 28, 30, the "T" head assembly 22 is finger manipulated to be closed about the members to be crimped. At the conclusion of this pre-positioning of both these members to be crimped and also the "T" head, then both the crimping linkage 62, and the safety linkage 60 have been sufficiently moved by the operator's finger forces, so the blocking member 58 of the safety linkage 60, clears the pin receiving volumes 54,56, in the hollow housing 42. Thereafter the trigger 46 is pivotable to open the air valve 50 and undertake the compressed air powered crimping of the members to be crimped, and the operator has her or his fingers out of the way of the closing upper and lower dies 28, 30.

Preferably, a monitoring linkage 66, is arranged within the hollow housing 42 to serve the operator by letting her or him know the members to be crimped are fully pre-positioned, by their finger manipulations, between the dies, which are then closed so the operator will not later have his or her fingers injured, when the compressed air power is utilized during the crimping of the members. Also the monitoring linkage assembly 68 serves to keep its monitoring linkage 66, the safety linkage 60 and the crimping linkage 62, from returning to their starting open die positions of the "T" head assembly 22, until the full compressed air powered crimping cycle has been completed, thereby, insuring a successful crimping of the members has been undertaken.

The "T" Head Assembly

The "T" head assembly 22 used in this hand held compressed air powered crimping tool 20 is similar to those "T" head assemblies used in the finger and hand completely manipulated crimping tools. The "T" head assembly 22 has two "T" sections 72, 74, joined by respective fastener 70, 71, with like entries to receive other components of the "T" head, and with holes to receive a fastener to join them to a crimping actuator. The support members 76 or the leg members 76 of each "T" section 72, 74, which depend from the top portions 78 of each "T" section 72, 74, are slidably positioned in the hollow housing 42, in respect to part of their lengths.

In respective entries 80, 82, of the "T" sections 72, 74, an upper insert 84 having the spaced upper dies 28 is adjustably positioned. An adjustment cam pin 86 passes through hole 88 in "T" section 72, then through a hole 92 in the upper insert 84, and thereafter through a like hole 88 in the other "T" section 74. Upon the selected rotation of the cam pin 86 against the force of spring 85, the pointing member 87 thereof, is moved, to one of four selectable positions, indicating the simultaneously movement of, the upper dies 28, via the movement of the upper insert 84, into a selected one of four respective spaced locations from lower dies 30.

The lower dies 30 are pin 94 positioned and held in an overall entry 96 of the hollow housing 42. The lower dies 30 are arranged respective sections 98, 102, 104, and 106. The upper and lower dies 28, 30, are arranged in spaced apart sets 24, 26, and each set is of a different size. The operator then, at any one operational time has two sets of dies of respective sizes to be selected for use in crimping members together.

Two Adjustable Stops Used In Positioning Members to be Crimped In A Respective Set of Dies The "T" head assembly 22 is preferably arranged to include two alike adjustable stops 100, one for each set of dies 24, 26. Each stop 100 has a depending elongated pin receiving entry 101. Pins 94 used in positioning the lower dies 30 in the overall entry 96 of the hollow housing 42, also are passed through the depending elongated receiving entries 101, to adjustably hold these stops 100 in their respective alternate positions.

In their in use position, a member to be crimped, such as the ring tongue terminal 32, is moved to contact an adjustable stop 100, in the same way pre-positioning of all the members to be crimped. In their non use position, each adjustable stop 100 is moved clear of the members to be crimped, via the clearance provided in the depending elongated receiving entry 101.

The Housing of the Hand Held Crimping Tool

The hollow housing 42 is preferably rectangular in its overall configuration and made in two pieces 108, 110. One piece 108 is made to have a larger receiving volume 112 to receive and to position the components of the crimping linkage 62, the safety linkage 60, and the monitoring linkage assembly 68. Also partially positioned within this larger receiving volume 112 are portions of the "T" head, and portions of the compressed air, i.e. pneumatic, actuator 40. In addition clearance volumes 114, not specifically formed, receive, at selected compressed air power operational times, the depending pins 52 of trigger 46, which pass through respective holes 116 in this housing piece 108.

The larger receiving volume 112 piece 108 of the hollow housing 42 includes a groove 118 to slidably receive and guide portions of the crimping linkage 62 and the safety linkage 60. Also this piece 108 includes a threaded entry 122 for securing the pneumatic actuator 40. In addition an opening 124 is provided for an air nipple connector 126, for connection to an airline 127 an opening 128 for an air valve 50, two openings 132 to receive mounting pins 134 to pivotally position left and right pivotal lever arms 136, 138, of the crimping linkage 62, and openings 142 to receive fasteners 144 that hold the pieces 108, 110, of the hollow housing together. Also during the assembly of this crimping tool 20 and the hollow housing 42, thereof, close fitting positioning pins 140 are arranged through positioning holes 141. The piece 108 of the hollow housing 42 also has internal compressed air passageways 146 to direct compressed air from the air nipple connector 126 to the air valve 50, then to the compressed air, i.e. pneumatic actuator 40.

The Crimping Linkage

The crimping linkage 62, is connected between the "T" head assembly 22 and the compressed air, i.e. pneumatic, actuator 40 and operationally mounted within the hollow housing 42. In FIGS. 5 and 6, the crimping linkage 62 is illustrated in the starting positions. During this starting time the members to be crimped together and being positioned between a set 24 or 26 of the dies, and the "T" head assembly is initially moved by finger applied force to move dies into firm contact with the members to be crimped. Under their finger applied force, the crimping linkage 62 in part, moves a distance, to also move the safety linkage 60, so the blocking member 58 clears away from the path of the depending pins 52 of the trigger 46.

Then, when the operator's fingers are well clear of the sets of dies 24, 26, the operator depresses the trigger 46, operating the valve 50, and compressed air enters and moves the compressed air, i.e. pneumatic, actuator 40, which inturn completes the movements of the crimping linkage 62, into the overall position shown in FIG. 7.

The several components of the crimping linkage 62 are also illustrated in FIGS. 4 and 13, and in respect to these several components, they are:

a) two spaced apart links 148, 152, as shown in FIG. 13, with respective spaced sets of aligned holes 154, 156;

b) a positioning pin 158 passed through the aligned holes 154 and through aligned holes 162 of the support members 76 of the "T" sections 72, 74, of the "T" head assembly 22, to thereby join the crimping linkage 62 to the "T" head assembly 22;

c) another positioning pin 164 passed through the aligned holes 156 and through the center of a roller bearing 166;

d) respective left and right pivotal lever arms 136, 138, each having respective offset pawls 174, 176, at one of their ends to movably contact the roller bearing 166, and each having at their other ends pin 178 mounted roller 182, and each being rotatably secured, with pins 134, between their ends to the hollow housing 42, in piece 108 thereof; and e) a moveable spreader 186 guided between the left and right pivotal arms 136, 138, utilizing the rollers 182, and connected to the pneumatic actuator 40.

This arrangement of the crimping linkage 62, when moved by the compressed air force, via the pneumatic actuator 40, creates a better and stronger crimping force applied, via the offset pawls 174, 176, of the left and right pivotal arms 136, 138, secured to the spaced apart links 148, 152, inturn secured to the "T" head assembly 22.

The Pneumatic Actuator, i.e. The Compressed Air Actuator

The pneumatic actuator 40, also referred to as the compressed air actuator 40, has an end 188 with threads 192 and an "O" ring 194 for threadably securing and sealing the end 188 in the threaded entry 122 of the hollow housing 42. The remaining portions of the pneumatic actuator 40, being cylindrical in shape, serve as the handle 44 of the crimping tool 20. A rod 190 extending from a piston, not shown, of the pneumatic actuator 40, movably extends into hollow housing 42 and is threadably attached to the movable spreader 186 of the crimping linkage 62.

The Compressed Air Guiding and Controlling Arrangement

The compressed air guiding and controlling arrangement 196 is illustrated in FIGS. 14 and 15. This arrangement 196 has:

a) a connector nipple 126 mounted in an entry 124 of the hollow housing 42 for connection to a compressed air supply line 127;

b) passageways 146 formed in the hollow housing 42, and specifically formed in piece 108 thereof, to guide the flow of entering compressed air, and subsequently in part to guide the flow of exhausting air. These passageways 146 direct the compressed air from the connection nipple 126 to the valve opening 128, serving as a valve chamber 204, into the air valve 50, and on to the cylinder 38, via orifices 208, thereof;

c) the cylinder 38, and piston, not shown, of the pneumatic actuator 40; and d) the valve 50 and the valve stem 48 thereof, having an exhaust orifice 212, with the valve stem 48 projecting out of the hollow housing 42 to be depressibly contacted by the trigger 46.

The Finger Depressible Trigger

The finger depressible trigger 46 is pivotally secured to piece 108 of the hollow housing 42, by a hinge arrangement 214. Two depending pins 52 are attached to the finger contacting portion 216 of the trigger 46. They are arranged to pass through respective entries 116 and into the pin receiving volumes 54, 56, in the hollow housing 42, when a blocking member 58 of a safety linkage 60 has been moved clear of the entries 116 of the pin receiving volumes 54, 56.

The Safety Linkage

The safety linkage 60 and its effective use is illustrated in FIGS. 1, 4, 5, 6, 7, 9, 10, 11, and 13. The safety linkage 60 is interconnected with the crimping linkage 62, by in effect being an integral extension 222 of link 152 of the two spaced apart links 148, 152, of the crimping linkage 62, as particularly shown in FIG. 13.

In FIGS. 1, 3, 5, and 9, the "T" head assembly 22 is illustrated when the sets 24, 26, of the crimping dies are spaced apart awaiting the entry of the members to be crimped. At the time the safety linkage 60 along with the crimping linkage 62 have been moved back to their starting positions by the force of the return coiled spring 222 as shown in FIG. 12.

When the members to be crimped are being positioned between a selected set 24 or 26 of dies, as indicated in FIG. 1, then as shown in FIGS. 5 and 9, a blocking member 58 of the safety linkage 60 is obstructing the entries 218 in the hollow housing 42, preventing the depending pins 52 of the trigger 46 from entering receiving volumes 54, 56, in the hollow housing 42. At this time the operator of this hand held crimping tool 20 is using his or her fingers, both to position the members to be crimped and also to move the set 24 or 26 of the dies together to preliminary bear against the members to be crimped, as shown in FIG. 10. At the last moments of this finger manipulation, the crimping linkage 62 and the safety linkage 60 have moved sufficiently, so the blocking member 58 clears the entries 218 in the hollow housing 42, as illustrated in FIG. 10.

Also at this time the operator has cleared his or her fingers from around the dies, and then he or she adjust his or her hand and fingers to enable the subsequent depressing of the trigger 46. In FIG. 11, the members initially to be crimped, are then shown to have been crimped, after the trigger has been actuated, resulting in the utilization of the compressed air power to complete their crimping.

The Monitoring Linkage Assembly

Preferably a monitoring linkage assembly 68, inclusive of a monitoring linkage 66, is utilized in respect to three functions. First, this assembly 68 is used to monitor the adequate finger forced moment of a set 24 or 26 of the dies about members to be crimped to keep them in their intended pre-positioning arrangement, while awaiting the utilization of the compressed air power. Second, this assembly 68 is used to monitor the adequate completion of the crimping of the members during the utilization of the compressed air power. Third, this assembly 68 is then used to clear the way for the crimping linkage 62, the safety linkage 60, and its own monitoring linkage 66, to be returned to their starting positions, via the return force of the coiled spring 222.

As shown in FIG. 12, the coiled spring 222, is confined and guided by the movable spreader 186. Also the coiled spring 222 extends between the end 188 of the rod 190 of the compressed air actuator 40, and the capped extending rod 218 having the cap 220, which directly contacts the coiled spring 222. The other end of the capped extending rod 218 directly contacts the roller bearings 116.

The monitoring linkage assembly 68 is illustrated in part in FIGS. 8 and 13, and then as assembled and utilized in FIGS. 9, 10, and 11. In FIG. 8, the hollow interior 224 of piece 110, serving as a cover 110, of the hollow housing 42 is shown as having a recess portion 226 serving to guide a portion of the monitoring linkage 66 and to position other components of the monitoring linkage assembly 68. In FIG. 13, the assembly of some of the crimping linkage 62 components, the safety linkage 60, and some of the components of the monitoring linkage assembly 68, is illustrated.

Of the two spaced apart links 148, 152, of the crimping linkage 62, the link 148 is integrally extended creating an extension 228, and further formed to have respective opposite side located alike functioning cams 232. Each cam 232 has two sets of clearances 234, 236, and a set of opposite extending portions 238 with ratchet teeth 242 on one side located axially at a slightly different location, i.e. offset location, than the ratchet teeth 242 on other side. This positioning creates more ratcheting positions, when the members to be crimped, are being firmly gripped in a set 24, or 26 of the dies, so they will remain in position, awaiting the crimping under the force derived from utilizing compressed air.

When this extension 228, serving as a part of this monitor linkage assembly is positioned in the recess portion 226 of the cover 110, the cams 232 thereof are operationally interfitted with additional components of this assembly 68, which are particularly shown in FIG. 8. They are the spaced pivotal pawls 244 rotatably mounted on the hollow housing 42 and having extending portions 246, which are able to movably contact the cams 232 and the ratchet teeth 242 thereof to create the monitoring effect during the finger applied forces used, when the members to be crimped are being positioned in the set 24 or 26 of the dies.

Respective coiled springs 248, secured to the hollow housing 42 and interfitted between their securement locations 252 and the spaced pivotal pawls 244, serve:

a) to keep the pawls 244 in their starting positions at the outset of a crimping operation b) to keep the pawls 244 in contact with the ratchet teeth 242 during the prepositioning of the members to be crimped; and c) after the powered crimping of the members, to clear the pawls 244 as all the linkages return to their starting positions.

What is claimed is:

1. A hand held compressed air powered crimping tool to secure ring tongue terminals to stripped electrical wire ends, and alternately to secure butt splices to join two electrical wire ends, first using hand and finger manipulations to position the members to be crimped, during a time when pressurized air flow is blocked to avoid any possible finger injuries, and then utilizing a compressed air powered actuator, crimping linkage, and crimping dies to crimp together the pre-positioned members, comprising:

a) a hollow housing, having a major receiving volume and a removable cover for the receiving volume, and having several entries to receive other components of the hand held crimping tool;

b) a "T" head comprising:

i two "T" sections having entries to receive other components of the "T" head, and having cross members, and having support members, having aligned holes, and these support members being slidably extendable together, in part of their lengths, through one of the entries of the hollow housing;

ii an upper insert positioned in a set of adjacent entries of the two "T" sections, having both upper left and upper right crimping dies and having a cam recess;

iii a rotatable adjustment pin for positioning both in another set of adjacent entries of the two "T" sections and also in the cam recess of the upper insert, to be selectably rotated to change the spaced apart positioning of the upper left and upper right crimping dies with other dies;

iv matching lower left and right sectional crimping dies with pin receiving entries, being the other dies, which are positioned in respective entries of the housing;

v two adjustable stops with elongated pin receiving entries to be alternately positioned in respective entries of the housing to locate the members to be crimped, or to clear the members to be crimped; and vi two pins to pass through entries of the two "T" sections, through the pin receiving entries of the matching lower left and lower right sectional crimping dies, and through the elongated pin receiving entries of the two adjustable stops;

c) a crimping linkage connected to the "T" head and to a pneumatic actuator, and positioned within the hollow housing, having two spaced apart links with respective spaced sets of aligned holes, a positioning pin passed through one set of the aligned holes and through aligned holes in the support member of the two "T" sections to connect the "T" head to the crimping linkage, and another positioning pin passed through the other set of aligned holes, while the pin also passes through the center of a roller bearing, respective left and right pivotal lever arms with respective offset pawls to movably contact the roller bearing at one of their ends, and with pin mounted rollers at their other ends, and rotatably secured with pins between their ends to the housing, a movable spreader guided between the left and right pivotal lever arms using their rollers and connected to a pneumatic actuator, and when moved by a pneumatic actuator, the spreader assists in creating a stronger crimping force;

d) a pneumatic actuator having an end thereof threadably secured and sealed by an "O" ring, in an entry of the hollow housing and having the remainder thereof, being the cylinder, serving as a handle of the crimping tool, and having a rod extending from the piston thereof to the hollow housing and threadably attached to the movable spreader, and thereby being attached to the crimping leakage;

e) a compressed air guiding and controlling arrangement consisting of a connection nipple mounted in an entry of the housing for connection to a compressed air supply line, passageways formed in the housing connecting the connection nipple, a valve chamber, and the cylinder of the pneumatic actuator via orifices thereof, and a valve positioned in the valve chamber and thereby being positioned in the housing and having a valve stem portion projecting above the housing;

f) a finger depressible trigger pivotally mounted on the housing, using a hinge positioned between the housing and the trigger, and located over the projecting valve stem portion, and having depending safety pins keeping the trigger from being depressed until their respective entries are cleared in the housing, after the operators fingers are cleared following the pre-positioning of the members to be crimped in the dies;

g) a safety linkage connected to and extending from the crimping linkage, having a blocking member, that is alternately positioned to block the depending safety pins from passing through their respective entries and into the housing, when the dies are separated as the "T" head remains in the fully opened position, and also when the "T" head is moved toward the housing by finger manipulations so the dies will pre-position the members to be crimped, and then when the finger manipulations are completed, the blocking member is alternatively positioned to be clear of the entries in the housing to subsequently allow the safety pins to enter the housing, as the trigger is depressed to open the air valve and have the compressed air directed to the pneumatic actuator;

h) a monitoring linkage assembly connected in part to the crimping linkage and positioned in part in the interior of the hollow cover of the hollow housing, comprising:

i pivotal pawls, with extending portions, rotatably mounted in the housing and initially positioned and returnably positioned, via the force of respective coil springs connected between the pivoted pawls and the housing ii link having one end connected, via a pin, to both the "T" head and the crimping linkage, a body portion connected, via a pin, to both the crimping linkage and the safety linkage, and the other end formed with opposite side alike cams providing both two sets of clearances and a set of opposite extending portions with ratchet teeth, slightly oppositely offset, and the said link, with the cams thereof, either contacts or alternatively clears the pivot pawls during the utilization of the hand held crimping tool;

Whereby at the outset of crimping operations, the monitoring linkage assembly is cleared of the pivoted pawls, then as the hand and finger manipulations are undertaken to pre-position the members to be crimped, the pivoted pawls are contacted by the set of opposite extending portions with the ratchet teeth, so the pre-positioning of the members to be crimped is maintained during the crimping action, and thereafter when the crimping action is fully completed, the link, with the cams thereof, clears the pivotal pawls, and the crimping linkage is moved by the force of the coiled spring to again position the "T" head to the starting position.

2. A hand held compressed air powered crimping tool, as claimed in claim 1, wherein the housing interior surfaces have guiding grooves to control the linear motions of respective portions of the crimping safety, and monitoring linkages.

3. A hand held compressed air power crimping tool, as claimed in claim 1, wherein the compressed air guiding and controlling arrangement also consists of a flexible and coilable compressed air supply line attached at one end to the connection nipple mounted in the housing and having a quick sealable connector at the other end, for subsequent connection to a compressed air supply line.

4. A hand held compressed air powered crimping tool to secure ring tongue terminals to stripped electrical wire ends, and alternately to secure butt splices to join two electrical wire ends, first using hand and finger manipulations to position the members to be crimped, during a time when pressurized air flow is blocked to avoid any possible finger injuries, and then utilizing a compressed air powered actuator, crimping linkage, and crimping dies to crimp together the pre-positioned members, comprising:

a) a hollow housing, having a major receiving volume and a removable cover for the receiving volume, and having several entries to receive other components of the hand held crimping tool;

b) a "T" head comprising:

i two "T" sections, having entries to receive other components of the "T" head, and having cross members, and having the support members, having aligned holes, and these support members being slidably extendable together, in part of their lengths, through one of the entries of the hollow housing;

ii an upper insert positioned in a set of adjacent entries of the two "T" sections, having both upper left and upper right crimping dies and having a cam recess;

iii a rotatable adjustment pin for positioning both in another set of adjacent entries of the two "T" sections and also in the cam recess of the upper insert, to be selectably rotated to change the spaced apart positioning of the upper left and upper right crimping dies with other dies;

iv matching lower left and right sectional crimping dies with pin receiving entries, being the other dies, which are positioned in respective entries of the housing;

v two adjustable stops with elongated pin receiving entries to be alternately positioned in respective entries of the housing to locate the members to be crimped, or to clear the members to be crimped; and vi two pins to pass through entries of the two "T" sections, through the pin receiving entries of the matching lower left and lower right sectional crimping dies, and through the elongated pin receiving entries of the two adjustable stops;

c) a crimping linkage connected to the "T" head and to a pneumatic actuator, and positioned within the hollow housing, having two spaced apart links with respective spaced sets of aligned holes, a positioning pin passed through one set of the aligned holes and through aligned holes in the support member of the two "T" sections to connect the "T" head to the crimping linkage, and another positioning pin passed through the other set of aligned holes, while the pin also passes through the center of a roller bearing, respective left and right pivotal lever arms with respective offset pawls to movably contact the roller bearing at one of their ends, and with a pin mounted rollers at their other ends, and rotatably secured with pins between their ends to the housing, a movable spreader guided between the left and right pivotal lever arms using their rollers and connected to a pneumatic actuator, and when moved by a pneumatic actuator, the spreader assists in enhancing the crimping force;

d) a pneumatic actuator having an end thereof threadably secured and sealed by an "O" ring, in an entry of the hollow housing and having the remainder thereof, being the cylinder, serving as a handle of the crimping tool, and having a rod extending from the piston thereof to the hollow housing and threadably attached to the movable spreader, and thereby being attached to the crimping leakage;

e) a compressed air guiding and controlling arrangement consisting of a connection nipple mounted in an entry of the housing for connection to a compressed air supply line, passageways formed in the housing connecting the connection nipple, a valve chamber, and the cylinder of the pneumatic actuator via orifices thereof, and a valve positioned in the valve chamber and thereby being positioned in the housing and having a valve stem portion projecting above the housing; and f) a finger depressible trigger pivotally mounted on the housing, using a hinge positioned between the housing and the trigger, and located over the projecting valve stem portion, and having depending safety pins keeping the trigger from being depressed until their respective entries are cleared in the housing, after the operators fingers are cleared following the pre-positioning of the members to be crimped in the dies.

5. A hand held compressed air powered crimping tool as claimed in claim 4, comprising, in addition:

a) a safety linkage connected to and extending from the crimping linkage, having a blocking member, that is alternately positioned to block the depending safety pins from passing through their respective entries and into the housing, when the dies are separated as the "T" head remains in the fully opened position, and also when the "T" head is moved toward the housing by finger manipulations so the dies will pre-position the members to be crimped, and then when the finger manipulations are completed, the blocking member is alternatively positioned to be clear of the entries in the housing to subsequently allow the safety pins to enter the housing, as the trigger is depressed to open the air valve and have the compressed air directed to the pneumatic actuator.

6. A hand held compressed air powered crimping tool to secure ring tongue terminals to stripped electrical wire ends, and alternately to secure butt splices to join two electrical wire ends, first using hand and finger manipulations to position the members to be crimped, during a time when pressurized air flow is blocked to avoid any possible finger injuries, and then utilizing a compressed air powered actuator, crimping linkage, and crimping dies to crimp together the pre-positioned members, comprising;

a) a hollow housing having a major receiving volume and a removable cover for the receiving volume, and having several entries and positioning structures to receive and/or to position other components of the hand held crimping tool;

b) a "T" head that presents, two sets of changeable size crimping dies, positioned in part outside the hollow housing and positioned in part slidably within the hollow housing;

c) a crimping linkage connected to the "T" head and to a pneumatic actuator, and positioned within the hollow housing;

d) pneumatic actuator sealably secured to the hollow housing at an entry thereof, and extending from the hollow housing to serve as a handle of the crimping tool, and having a rod extending from the piston thereof into the hollow housing and secured to the crimping linkage;

e) a compressed air guiding and controlling system consisting of a connection nipple mounted in an entry of the housing for connection to a compressed air line, air passageways formed in the housing connecting the connection nipple entry, a valve chamber formed in the housing, and the pneumatic actuator in respect to the cylinder thereof and orifices of the cylinder, and a valve, positioned in the valve chamber, having a valve stem portion projecting above the housing;

f) a finger depressible trigger pivotally mounted on the housing and located over the projecting valve stem portion and having at least one depending safety pin, keeping the trigger from being actuated until an entry in the housing is opened to receive the depending safety pin, and the finger trigger is then actuated to move the valve stem operating the valve so compressed air enters the compressed air guiding and controlling system, after the operator's fingers are cleared from the dies following the pre-positioning of the members to be crimped in the dies; and g) a safety linkage connected to and extending from the crimping linkage, having a blocking member that is alternately positioned to block an entry of the at least one depending safety pin of the finger depressible trigger, during the operational periods when the dies are spaced apart and when the dies are moved, via finger manipulations, to pre-position the members to be crimped, and then at the conclusion of the pre-positioning, the blocking member is repositioned to clear the entry for the passing of the at least one depending safety pin, when the finger depressible trigger is pivoted to move the valve stem opening the valve, so compressed air power is utilized, when the members are crimped together, when the operators fingers remain clear of the crimping dies.

7. A hand held compressed air powered crimping tool, as claimed in claim 6, comprising, in addition:

a) a monitoring linkage assembly connected in part to the crimping linkage and positioned in part both in the hollow housing and in the interior of the hollow cover of the hollow housing, having changeable operational positions of members of the linkage assembly, which sequentially: secure the pre-positioning of the dies about the members to be crimped; keep the crimping dies in their crimping operational period until the crimping operation is fully completed; and then clear the crimping linkage for the return thereof to the open position, when members crimped together are removed from the "T" head and new members are pre-positioned for the follow on crimping action.

* * * * *